US010786701B1

(12) United States Patent
Ellis

(10) Patent No.: US 10,786,701 B1
(45) Date of Patent: Sep. 29, 2020

(54) DUAL FUNCTION EXERCISE MACHINES WITH BI-DIRECTIONAL RESISTANCE

(71) Applicant: Joseph K. Ellis, Ocala, FL (US)

(72) Inventor: Joseph K. Ellis, Ocala, FL (US)

( * ) Notice: Subject to any disclaimer, the term of this patent is extended or adjusted under 35 U.S.C. 154(b) by 0 days.

(21) Appl. No.: 16/370,941

(22) Filed: Mar. 30, 2019

(51) Int. Cl.
*A63B 21/00* (2006.01)
*A63B 23/04* (2006.01)

(52) U.S. Cl.
CPC ..... *A63B 21/153* (2013.01); *A63B 21/4031* (2015.10); *A63B 21/4034* (2015.10); *A63B 23/0494* (2013.01)

(58) Field of Classification Search
CPC ..... A63B 21/0058; A63B 21/00061; A63B 21/00065; A63B 21/00069; A63B 21/00076; A63B 21/00192; A63B 21/005; A63B 21/0052; A63B 21/0056; A63B 21/0057; A63B 21/012; A63B 21/0125; A63B 21/151; A63B 21/152; A63B 21/153; A63B 21/154; A63B 21/155; A63B 21/156; A63B 21/157; A63B 21/22; A63B 21/225; A63B 21/4011; A63B 21/4017; A63B 21/4027; A63B 21/4029; A63B 21/4031; A63B 21/4033; A63B 21/4034; A63B 21/4035; A63B 21/4045; A63B 21/4047; A63B 21/4049; A63B 23/035; A63B 23/03516; A63B 23/03525; A63B 23/04; A63B 23/0405; A63B 23/0482; A63B 23/0494; A63B 23/12; A63B 23/1209; A63B 23/1245; A63B 23/1281; A63B 71/0054; A63B 2071/0063; A63B 2071/0072; A63B 2071/0081; A63B 2244/09; A63B 21/15
See application file for complete search history.

(56) References Cited

U.S. PATENT DOCUMENTS 4,900,013 A * 2/1990 Rodgers, Jr. ..... A63B 21/00178 482/6
4,984,986 A * 1/1991 Vohnout ..... A63B 24/00 434/247
5,072,929 A * 12/1991 Peterson ..... A63B 22/0012 482/72
5,090,694 A * 2/1992 Pauls ..... A63B 21/015 482/118
5,147,265 A * 9/1992 Pauls ..... A63B 21/015 482/115
5,195,937 A * 3/1993 Engel ..... A63B 21/015 482/116
5,302,161 A * 4/1994 Loubert ..... A63B 21/015 482/116

(Continued)

*Primary Examiner* — Gary D Urbiel Goldner
(74) *Attorney, Agent, or Firm* — Laurence P. Colton; Smith Tempel Blaha LLC

(57) ABSTRACT

An exercise machine with a user support and at least one user engagement actuator and a one directional rotational resistance flywheel for performing exercises that are resisted in the push direction and the pull direction. The drive system that operatively connects the at least one user engagement actuator to the one directional rotational resistance flywheel is configured such that more or less force is required to move the at least one user engagement actuator in the push direction than to move the at least one user engagement actuator in the pull direction.

3 Claims, 8 Drawing Sheets

(56) References Cited

U.S. PATENT DOCUMENTS

| | | | | | |
|---|---|---|---|---|---|
| 5,354,251 | A * | 10/1994 | Sleamaker | A63B 21/156 | 482/96 |
| 5,356,356 | A * | 10/1994 | Hildebrandt | A63B 21/157 | 482/57 |
| 5,496,241 | A * | 3/1996 | Sellers | A63B 21/157 | 482/110 |
| 6,004,244 | A * | 12/1999 | Simonson | A63B 21/153 | 482/51 |
| 8,888,661 | B2 * | 11/2014 | Ellis | A63B 21/0615 | 482/72 |
| 9,700,753 | B1 * | 7/2017 | Boatwright | A63B 21/4043 | |
| 10,220,247 | B2 * | 3/2019 | Ellis | A63B 21/4035 | |
| 2002/0016237 | A1 * | 2/2002 | Schmidt | A63B 21/015 | 482/70 |
| 2007/0037667 | A1 * | 2/2007 | Gordon | A63B 22/0056 | 482/51 |
| 2008/0051260 | A1 * | 2/2008 | Simonson | A63B 69/182 | 482/52 |
| 2008/0280736 | A1 * | 11/2008 | D'Eredita | A63B 21/154 | 482/72 |
| 2010/0144496 | A1 * | 6/2010 | Schmidt | A63B 21/4035 | 482/70 |
| 2013/0337981 | A1 * | 12/2013 | Habing | A63B 21/00072 | 482/110 |
| 2017/0319941 | A1 * | 11/2017 | Smith | A63B 21/153 | |
| 2018/0111019 | A1 * | 4/2018 | Ellis | A63B 22/0023 | |
| 2018/0147436 | A1 * | 5/2018 | Ellis | A63B 23/03558 | |
| 2019/0105526 | A1 * | 4/2019 | Boatwright | A63B 21/00069 | |
| 2019/0134451 | A1 * | 5/2019 | McCall | A63B 21/225 | |

* cited by examiner

DUAL FUNCTION EXERCISE MACHINES WITH BI-DIRECTIONAL RESISTANCE

BACKGROUND OF THE INVENTION

Technical Field

This invention relates to the general technical field of exercise, physical fitness and physical therapy equipment and machines. This invention relates more specifically to the field of dual function strength training exercise machines with bi-directional resistance.

Prior Art

Strength training machines are available in various configurations and for all of the major muscle groups. Most strength training machines have a single function and provide resistance in only one direction, for example an arm curl machine for strengthening a user's biceps or a chest press machine for strengthening a user's pectoral muscles. Generally, the exercise function of these machines is resisted with gravity fed weights connected to a user engagement feature by a flexible component such as a cable or belt such that the exercise is resisted when the weight is being lifted and not resisted when the weight is being lowered.

Some weight training machines provide more than one function but most require the user to perform a number of repetitions of one function, for example a leg extension exercise and then the user will have to reconfigure some of the adjustable components of the machine prior to performing a number of repetitions of the opposite exercise such as a leg curl exercise. This is because the machine only provides resistance in one direction.

Hydraulically resisted exercise machines can provide bi-directional resistance and many of these machines are configured with a dual function such as a vertical push to strengthen a user's shoulder muscles and a reciprocating vertical pull to strengthen a user's back muscles. However, these machines have several shortcomings, for example they provide a jerky feel when the actuator component changes direction to move in the reciprocating direction because the fluid in the resistance cylinder has to be moved in the opposite direction. Also, these machines will not automatically change the level of resistance when the actuator changes direction. This is a deficiency because most of these combinations of reciprocating exercises engage two different set of muscles that do not have the same strength capabilities. For example, a user's quadriceps which are engaged in a leg extension motion are much larger and stronger than a user's hamstrings which would be engaged in the reciprocating leg curl motion. Another deficiency is that a single hydraulic resistance cylinder could not be practically shared by two separate users on separate machines without one user's exercise motion impeding the exercise motion of the second user.

Two primary excuses people use for not exercising are not having enough time and the boredom associated with exercising and thus they lack the motivation. The present invention optimizes each user's time when exercising and can provide camaraderie to help keep users motivated and make exercising an enjoyable and rewarding experience.

BRIEF SUMMARY OF THE INVENTION

The present invention provides a series of exercise machines wherein each machine performs two reciprocating exercises. A first set of muscles are resisted and activated when a user engages an actuating arm in a pushing motion and a second set of muscles are resisted and activated when the user engages the same actuating arm in a reciprocating pulling motion. The actuating arm is operatively connected to a drive axle and said drive axle is operatively connected to a second axle which is rigidly connected to a one directional flywheel and said flywheel is engaged with a braking mechanism for providing resistance to each direction of the actuating arm. The drive axle is operatively connected to the flywheel axle and resistance flywheel with a first one-way clutch to propel the resistance flywheel when the actuating arm in moved in the push direction and the drive axle is operatively connected to the flywheel axle and resistance flywheel with a second one-way clutch to propel the resistance flywheel when the actuating arm is moved in the pull direction. The first and second operative connection of the drive axle to the flywheel axle and resistance flywheel are mechanically configured such that the pushing motion and the opposite pulling motion of the actuating arm propel the resistance flywheel in one direction only. The first and second operative connections of the drive axle to the flywheel axle and the resistance flywheel can also be optimized such that the resistance to the push motion can be more, less or equal to the resistance to the pull motion.

In a single user embodiment of the machine, one dual function exercise station will be operatively connected to a single one directional flywheel resistance mechanism. Generally, each machine with engage the user's arms only or engage the user's legs only.

Other embodiments of the machine are configured for one or two users, wherein a first dual function exercise station and a second dual function exercise station will both be operatively connected to a common single one directional flywheel resistance mechanism. In these embodiments, a single user on either the first dual function exercise station or the second dual function exercise station can propel the one directional flywheel resistance mechanism while the other dual function exercise station is not being used or both a first user on the first dual function exercise station and a second user on the second dual function exercise station can exercise simultaneously and jointly propel the one directional flywheel resistance mechanism. The one-way clutches operatively connecting the user engagement actuators of each station to the common flywheel axle and common one directional resistance flywheel mechanism will allow each user to put energy into propelling the common flywheel resistance system without impeding the motion of the other user. Preferably these two-person exercise stations will be configured with two of the same dual function stations that are operatively connected to the common single one directional flywheel resistance mechanism. Each station may be configured slightly different to accommodate the connection to the common resistance mechanism. For example, there may be left and right connection components to the common resistance mechanism and there may be a left and right configuration so that each user can easily enter and exit each side of the machine. However, each of the two stations will produce the same exercise function and generally each of the two stations will engage the user's arms only or engage the user's legs only.

In all embodiments of the invention each user is optimizing their time by getting both a resisted push motion and a resisted pull motion with each reciprocating repetition as opposed to the single direction resistance of most machines. In each of the two station configurations, the two users can work as a team to encourage and motivate each other and create a more satisfying exercise experience. Also, a series of two station machines can be grouped together such that each machine works a different set of push and pull muscle groups such that multiple users can rotate among the various machines to exercise as a team while working all major muscle groups and getting a more complete workout in a shorter period of time in an atmosphere of camaraderie.

DETAILED DESCRIPTION OF PREFERRED EMBODIMENTS

Exemplary preferred embodiments are disclosed below in connection with the attached drawings. Throughout this specification, various terms will be used to describe various components or features. For example, the term two-station machine will refer to a configuration of the machine with two user supports such that one user can exercise alone or two users can exercise simultaneously on the same machine. The term single station or one station machine will refer to a configuration of the machine with one user support that allows one user only to exercise on the machine. The term drive assembly will refer to all of the components that transfer the motion and energy the user applies to the engagement actuator to the resistance system. The term drive axle will refer to the axle that is connected to and rotated by the user engagement actuator. In some embodiments, the connection will be direct and in others the connection may be connected by linkage components. The term resistance system will refer to all of the components that work together to resistance the movements of the user engagement actuator. The term one-way clutch will refer to the components that are attached to the resistance flywheel axle that is rigidly connected to the one directional resistance flywheel and these one-way clutches engage and propel the resistance flywheel axle in one direction but are passive to the movement of the resistance flywheel axle in the opposite direction.

FIGS. 1-4, 7, and 8 are all views of exemplary embodiments of the invention this inventor terms a Dual Function Exercise Machines with Bi-Directional Resistance. Generally, the invention is a series of machines that allows the user to perform two exercises in one push and pull reciprocating motion. The user engages a pivoting actuator that is operatively connected to a one directional flywheel resistance. The invention can be configured as two stations to allow two exercises to work against a single, common resistance system or one of the two stations can be unmanned and one person can work alone against the common resistance system. The invention can also be configured as one station with a single resistance system. These embodiments illustrate a leg extension combined with a leg curl dual function machine for activating a user's quadriceps muscles in a push direction and for activating a user's hamstring muscles in a pull direction. However, other examples of the invention Dual Function Exercise Machines with Bi-Directional Resistance can include but are not limited to: an arm curl combined with a triceps extension, a shoulder press combined with a latissimus pulldown, a chest press combined with a back row, and a leg press combined with an abdominal leg pull. The components and supporting structure of the machine can be constructed of various materials capable of supporting and operating the device, with metal components being the most commonly used material.

Figure 1:
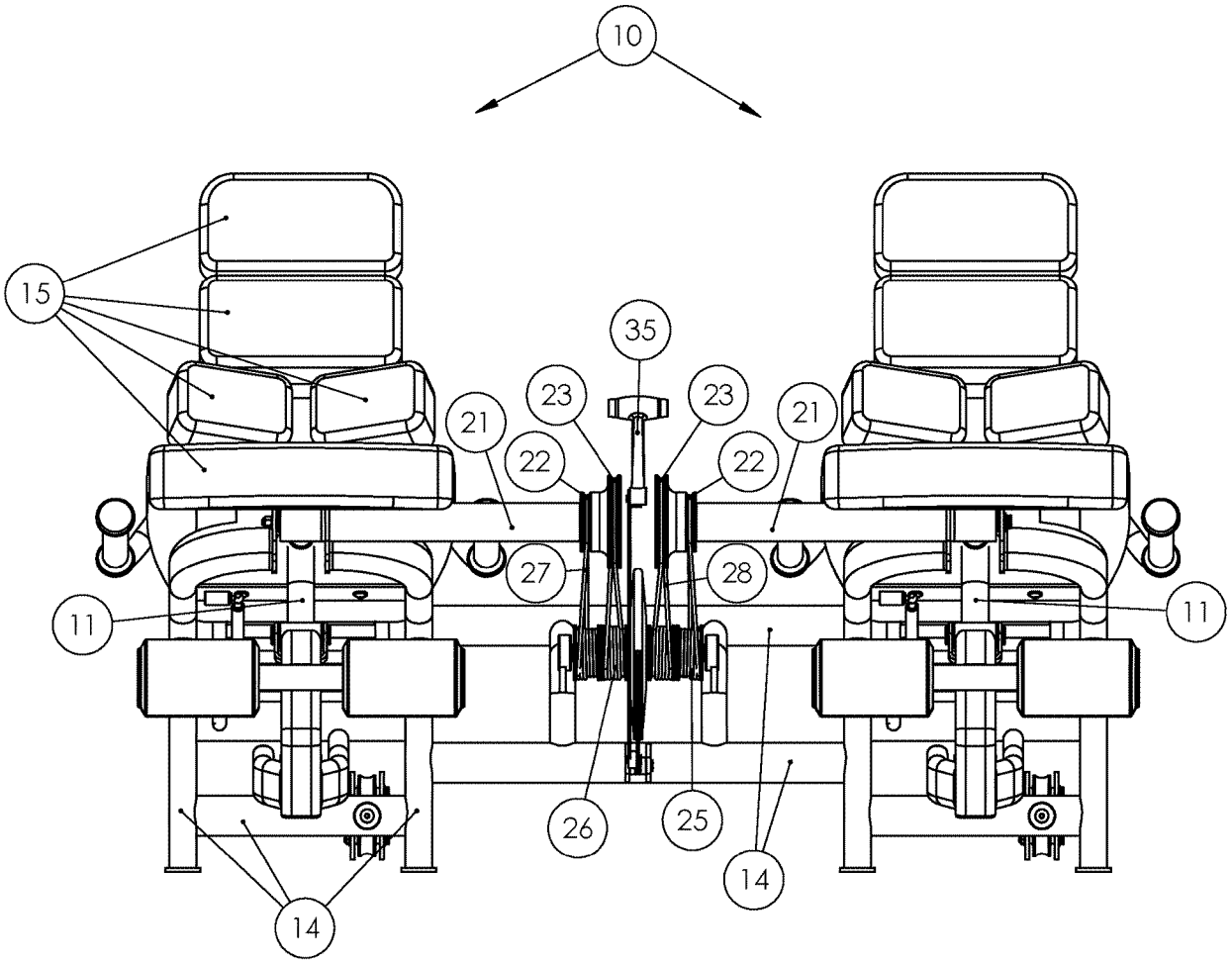
FIG. 1 is a front view of a two-station configuration of the invention.
Figure 2:
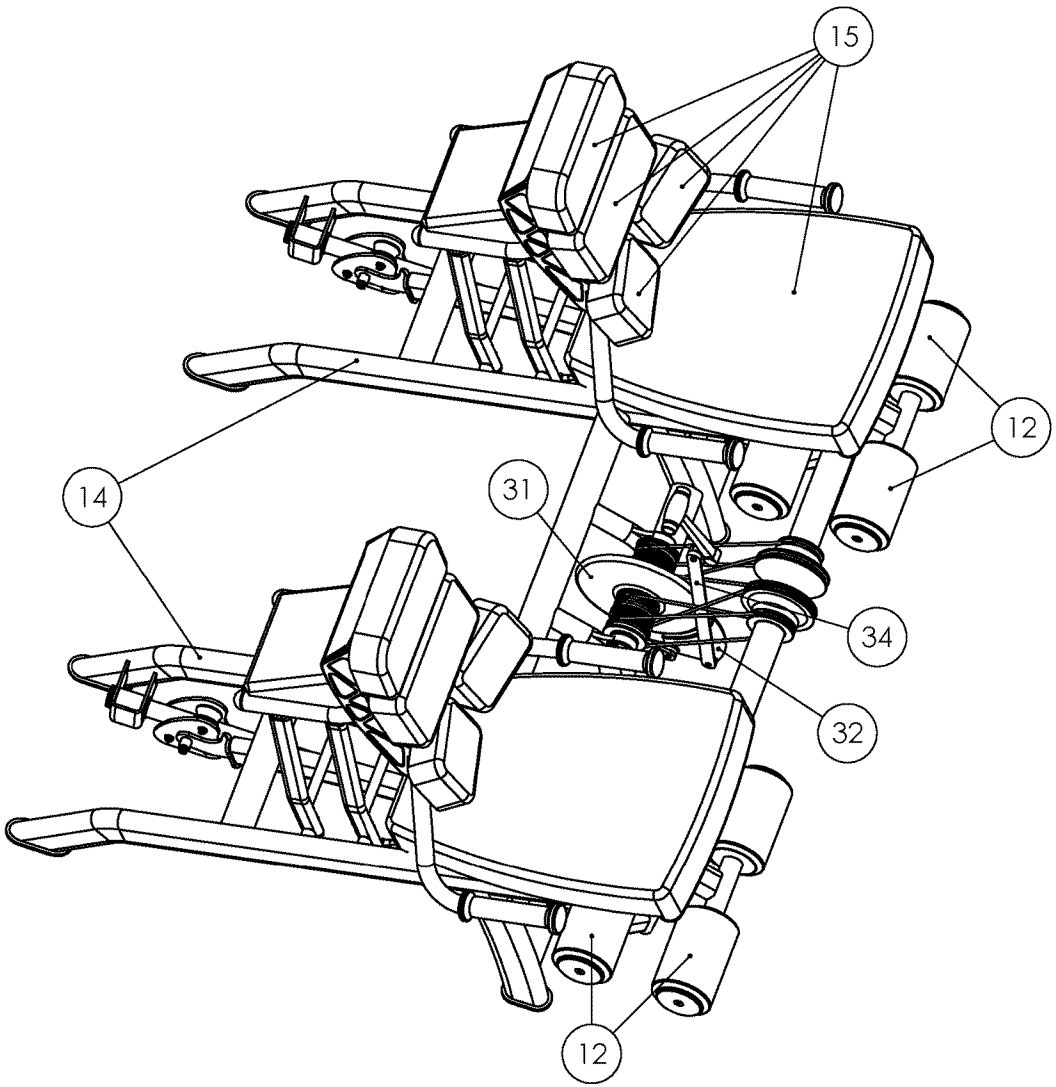
FIG. 2 is an elevated perspective view of a two-station configuration of the invention.
Figure 3:
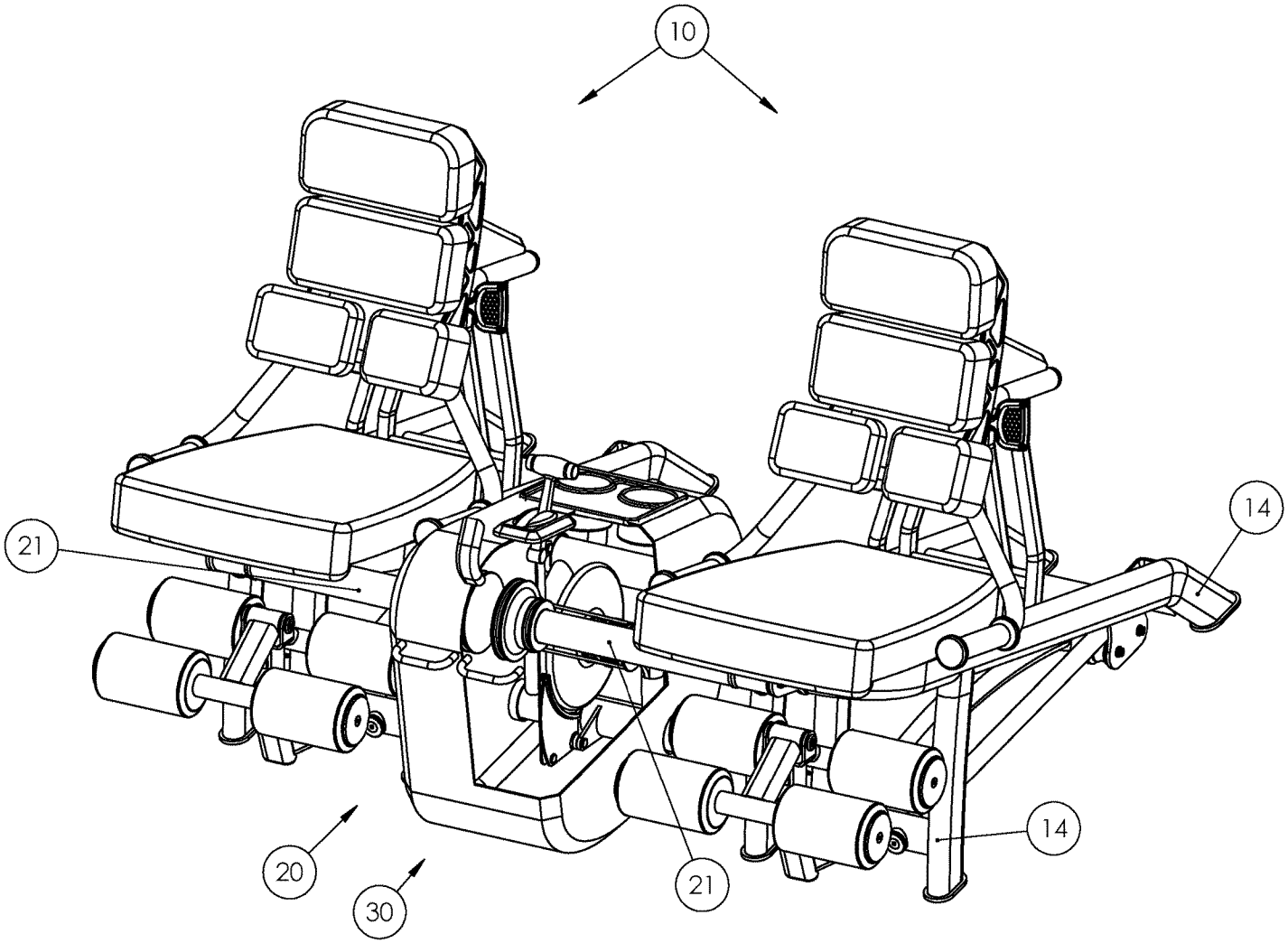
FIG. 3 is a front perspective view of a two-station configuration of the invention.
Figure 4:
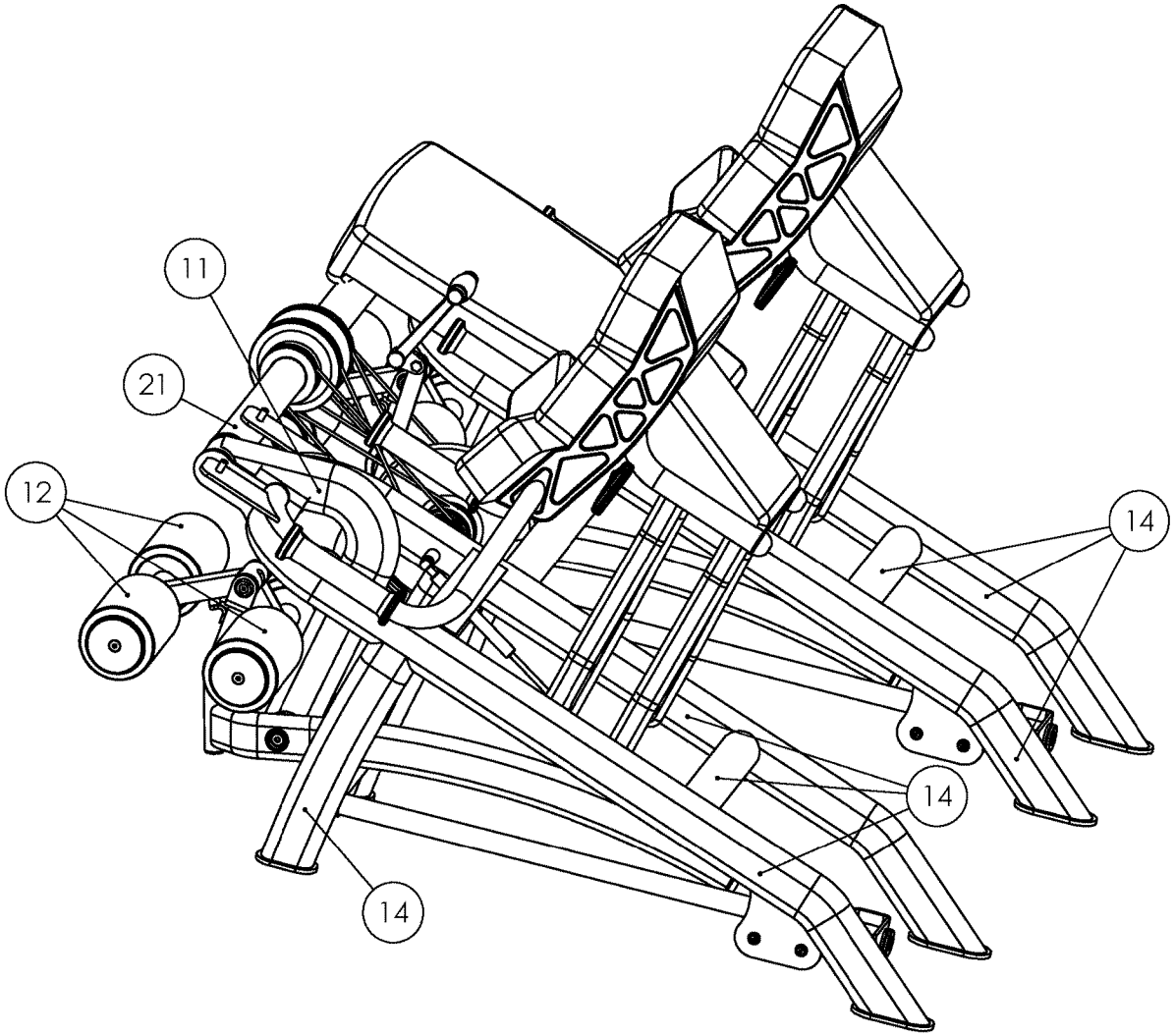
FIG. 4 is a rear perspective view of a two-station configuration of the invention with the user seat removed to better illustrate some of the components.
Figure 5:
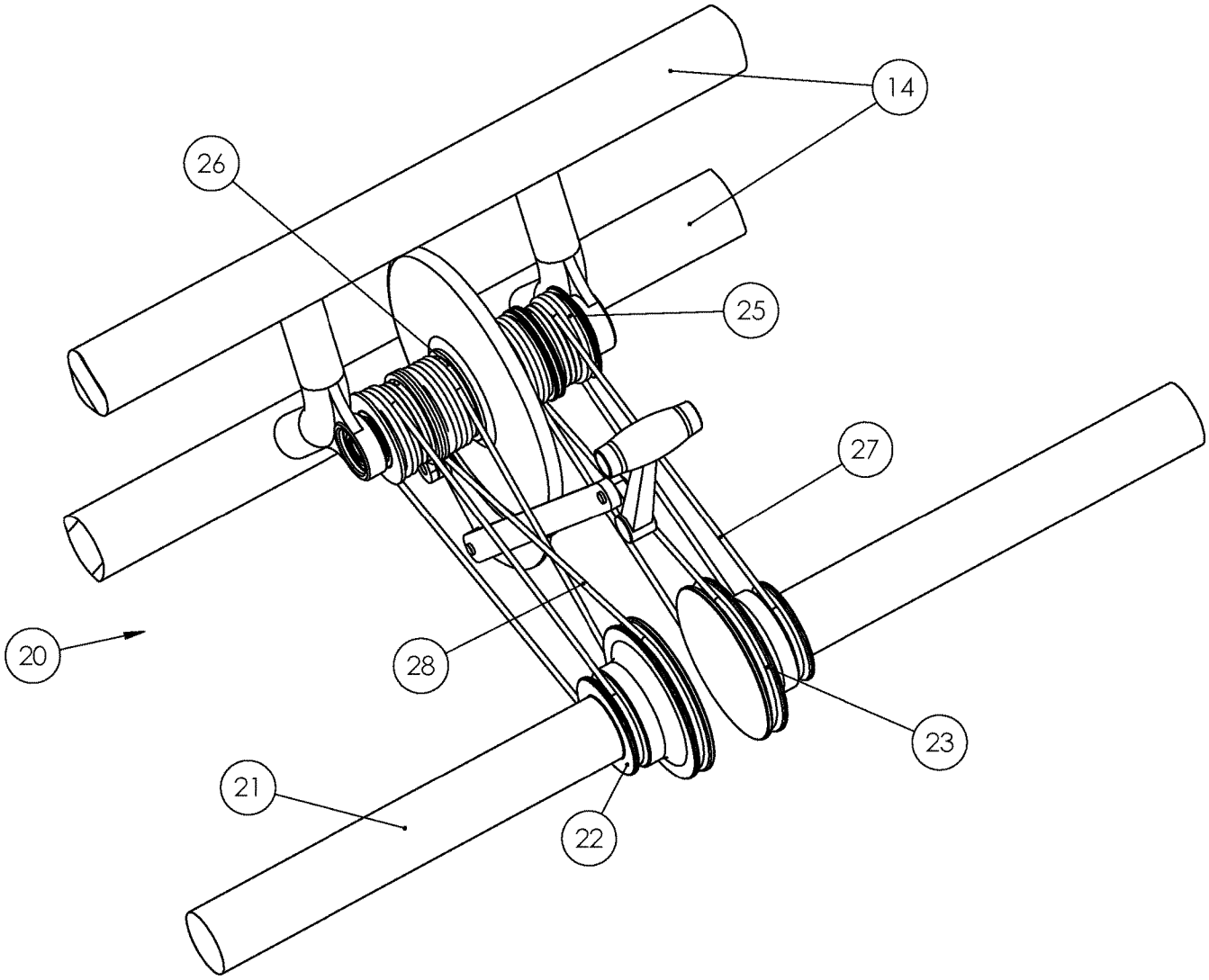
FIG. 5 is a perspective view of the drive axle and resistance system of the invention.
Figure 6:
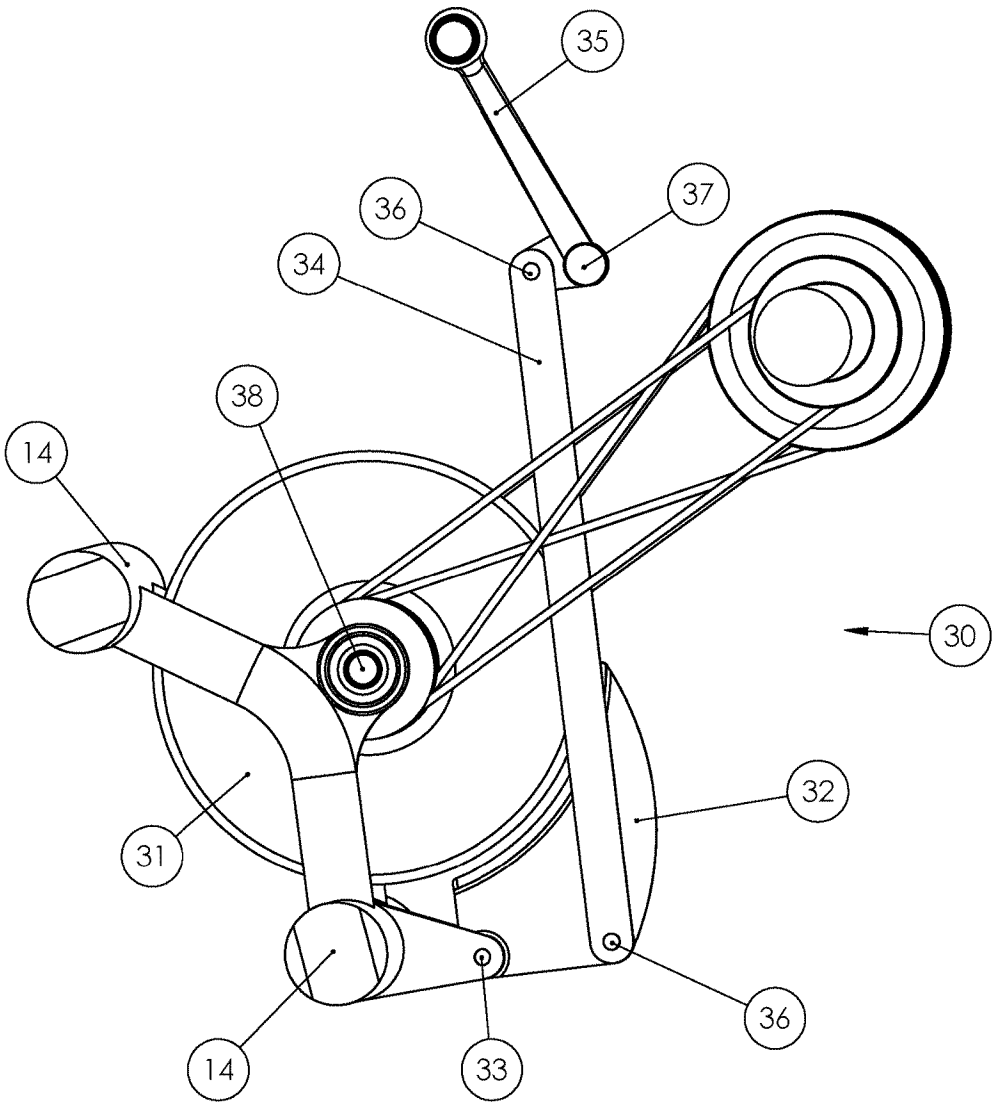
FIG. 6 is a side view of the drive axle and resistance system of the invention.

FIGS. 5 and 6 are views of an exemplary drive assembly and resistance system of the invention. Various components can be used to create the drive assembly and resistance system and the preferred components of both the drive assembly and resistance system will be described herein.

FIGS. 1-8 illustrate a more complete understanding of the invention. In exemplary embodiments, support frame 14 is constructed of various connected stationary tubes or bars and brackets. User supports 15, user engagement actuator arm 11, drive assembly 20 and resistance system 30 are all mounted on support frame 14.

In exemplary embodiments, a user engagement contact point component such as user engagement actuator pads 12 are connected to a user engagement actuator arm 11. In other embodiments of the invention (not illustrated), the user may engage a user engagement actuator arm 11 with the users hands and or arms only or may engage a user engagement actuator arm 11 with the user's feet and or legs only and the engagement contact point may comprise various engagement components such as hand grips, arm restraints, foot platforms, foot or leg restraints, arm or leg pads, or a combination thereof. Said user engagement contact point components can be connected to user engagement actuator arm 11 in various configurations such as but not limited to a rigid connection, a pivoting connection, or a linkage connection.

In exemplary embodiments drive assembly 20 is comprised of at least one drive axle 21, at least one small drive pulley 22, at least one large drive pulley 23, at least one outer one-way clutch 25, at least one inner one-way clutch 26, at least one outer drive cable 27, and at least one inner drive cable 28. For two-station embodiments each of the components of drive assembly 20 are duplicated such that there is one complete set of components for each of the two stations. Small drive pulley 22 and large drive pulley 23 are rigidly connected to drive axle 21. Outer one-way clutch 25 and inner one-way clutch 26 are mounted on and operatively connected to resistance flywheel axle 38 and outer one-way clutch 25 and inner one-way clutch 26 oscillate on resistance flywheel axle 38 during operation of machine 10 such that a first directional movement of user engagement actuator arm 11 and drive axle 21 causes outer one-way clutch 25 to engage and propel resistance flywheel axle 38 and resistance flywheel 31 while inner one-way clutch 26 remains disengaged and passively rotates on resistance flywheel axle 38 and the reciprocating and opposite directional movement of user engagement actuator arm 11 and drive axle 21 causes inner one-way clutch 26 to engage and propel resistance flywheel axle 38 and resistance flywheel 31 while outer one-way clutch 25 remains disengaged and passively rotates on resistance flywheel axle 38. Small drive pulley 22 is operatively connected to outer one-way clutch 25 with outer drive cable 27 and large drive pulley 23 is operatively connected to inner one-way clutch 26 with inner drive cable 28. As illustrated outer drive cable 27 is configured in a straight oval shaped loop and inner drive cable 28 is configured in an offset "figure 8" shaped loop. The offset "figure 8" configuration of inner drive cable 28 allows outer one-way clutch 25 and inner one-way clutch 26 to propel the resistance flywheel axle 38 and resistance flywheel 31 in one direction only as the drive axle 21 oscillates in a back and forth motion during operation of machine 10. However, the configurations of outer drive cable 27 and inner drive cable 28 can be reversed and achieve the same operation of machine 10. Outer drive cable 27 is tensioned sufficiently to prevent slippage of outer drive cable 27 on small drive pulley 22 and outer one-way clutch 25 and inner drive cable 28 is tensioned sufficiently to prevent slippage of inner drive cable 28 on large drive pulley 23 and inner one-way clutch 26 during operation of machine 10.

In exemplary embodiments of drive assembly 20, drive axle 21 is rigidly connected to two drive pulleys such as small drive pulley 22 and large drive pulley 23. The "small" and "large" description of the drive pulleys refers to their outside diameter dimension. Larger outside diameter drive pulleys require greater force to rotate drive axle 21, resistance flywheel axle 38, and resistance flywheel 31. Smaller outside diameter drive pulleys require less force to rotate drive axle 21, resistance flywheel axle 38, and resistance flywheel 31. This is a very useful feature for this invention as some push motion muscle groups are naturally stronger or weaker than the reciprocating pull motion muscle group. Each of the two drive pulleys for drive axle 21 can also be configured as having the same outside diameter dimension if it is appropriate for a particular machine to have an equal resistance to the push and pull exercise motions.

In exemplary embodiments resistance system 30 is comprised of a resistance flywheel axle 38, a resistance flywheel 31, a resistance magnet 32, a resistance magnet pivot 33, a resistance magnet adjustment lever 35, a resistance magnet adjustment lever pivot 37, a resistance magnet adjustment linkage 34, and resistance magnet adjustment linkage pivots 36. Resistance flywheel axle 38, resistance magnet pivot 33, and resistance magnet adjustment lever pivot 37 are all mounted on portions of support frame 14. Resistance flywheel axle 38, resistance flywheel 31, and resistance magnet 32 can be located in various locations on support frame 14 suitable for the configuration of each individual machine 10 such that resistance system 30 can be operatively linked to drive assembly 20. Resistance magnet 32 is illustrated as magnetically engaging the outer perimeter of resistance flywheel 31 but resistance magnet 32 can magnetically engage resistance flywheel 31 on various surfaces of resistance flywheel 31 for creating a resistance to the rotation of resistance flywheel 31 during operation of machine 10. Resistance flywheel axle 38 and resistance flywheel 31 are rigidly connected such that resistance flywheel axle 38 and resistance flywheel 31 rotate as one during operation of machine 10 and resistance flywheel axle 38 and resistance flywheel 31 can only rotate in one direction.

In exemplary embodiments of the invention, the amount of resistance that resistance system 30 will generate can be adjusted prior to the operation of machine 10 or during operation of machine 10 by moving resistance magnet adjustment lever 35. Forward movement of resistance magnet adjustment lever 35 causes resistance magnet adjustment lever 35 to pivot on resistance magnet adjustment lever pivot 37 causing resistance magnet adjustment linkage 34 to pivot on resistance magnet adjustment linkage pivots 36 and move upward causing resistance magnet 32 to pivot upward on resistance magnet pivot 33 moving resistance magnet 32 more proximal to flywheel 31 which increases resistance to the rotational movement of flywheel 31. Rearward movement of resistance magnet adjustment lever 35 causes resistance magnet adjustment lever 35 to pivot on resistance magnet adjustment lever pivot 37 causing resistance magnet adjustment linkage 34 to pivot on resistance magnet adjustment linkage pivots 36 and move downward causing resistance magnet 32 to pivot downward on resistance magnet pivot 33 moving resistance magnet 32 more distal from flywheel 31 which decreases resistance to the rotational movement of flywheel 31.

Figure 7:
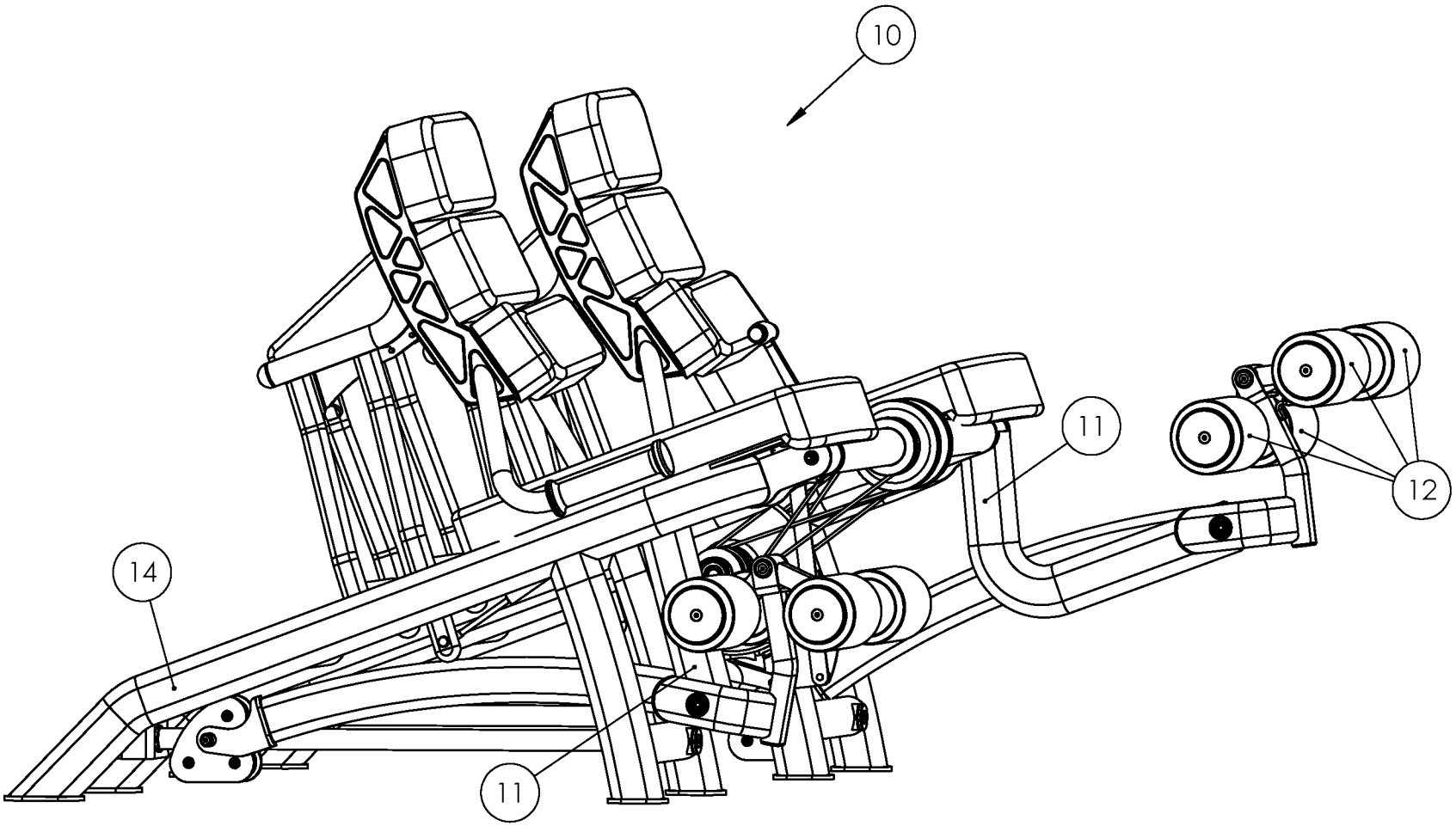
FIG. 7 is a front perspective view of a two-station configuration of the invention.

FIGS. 1-4 and 7 illustrate a two-station embodiment of the invention wherein one user can operate a first of the two stations of machine 10 to propel resistance system 30 while the second of the two stations is not being operated or a first user on a first of the two stations and a second user on a second of the two stations can simultaneously but independently operate machine 10 to jointly propel resistance system 30. During operation of machine 10 of the two-station embodiment, the drive assembly 20 of a first of the two stations operates independently of the drive assembly 20 of a second of the two stations, wherein resistance flywheel axle 38 and resistance flywheel 31 can only rotate in one direction and outer one-way clutches 25 and inner one-way clutches 26 oscillate on resistance flywheel axle 38 to propel resistance flywheel axle 38 and resistance flywheel 31 during operation of machine 10 as previously described herein. The independent feature of the operation of a two-station embodiment of machine 10 is illustrated in FIG. 7 wherein the user engagement actuator arm 11 and the user engagement actuator pads 12 are in the extended position on the first of the two stations and the user engagement actuator arm 11 and the user engagement actuator pads 12 are in the contracted position on the second of the two stations.

Figure 8:
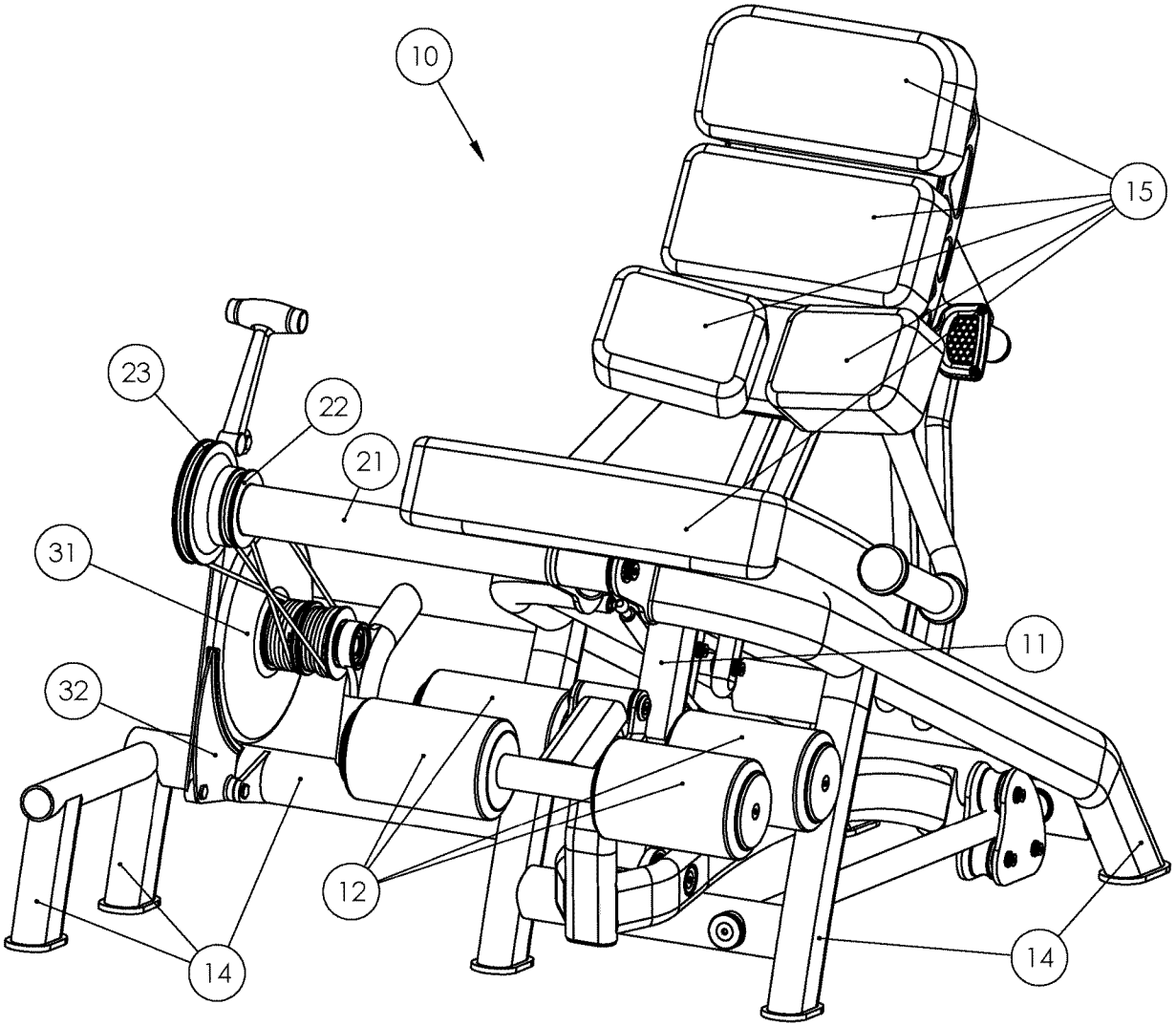
FIG. 8 is a front perspective view of a one-station configuration of the invention.

FIG. 8 illustrates a one station embodiment of the invention wherein one user operates machine 10 to propel resistance system 30. During operation of machine 10 of the one-station embodiment, resistance flywheel axle 38 and resistance flywheel 31 can only rotate in one direction and outer one-way clutches 25 and inner one-way clutches 26 oscillate on resistance flywheel axle 38 to propel resistance flywheel axle 38 and resistance flywheel 31 during operation of machine 10 as previously described herein.

The two-station embodiment of machine 10 as illustrated in FIGS. 1-4 and 7 is operated as follows. One or two users enter machine 10 by sitting and leaning upon user supports 15 and placing their lower legs in between the two sets of user engagement actuator pads 12. One of the users can then adjust resistance system 30 to the desired resistance setting by moving resistance magnet adjustment lever 35 to the desired position to adjust resistance magnet 32 thereby increasing or decreasing the resistance to the motion of machine 10 as previously described herein. When one or both users move user engagement actuator pads 12 in a first direction, it causes the respective user engagement actuator arm or arms 11 to rotate, this causes drive axle 21 to rotate causing small drive pulley 22 and large drive pulley 23 to rotate in the same direction with drive axle 21, this causes outer drive cable 27 to rotate outer one-way clutch 25 which engages onto resistance flywheel axle 38 and propels resistance flywheel axle 38 and resistance flywheel 31. Simultaneously inner drive cable 28 rotates inner one-way clutch 26 in the opposite direction of outer one-way clutch 25 such that inner one-way clutch 26 is disengaged from resistance flywheel axle 38 and passively rotates on resistance flywheel axle 38.

When one or both users move user engagement actuator pads 12 in a second and opposite reciprocating direction this causes the respective user engagement actuator arm or arms 11 to rotate in the opposite direction, this causes drive axle 21 to rotate in the opposite direction causing small drive pulley 22 and large drive pulley 23 to rotate in the same opposite direction with drive axle 21, this causes outer drive cable 27 to rotate outer one-way clutch 25 in the opposite direction which disengages from resistance flywheel axle 38 and passively rotates on resistance flywheel axle 38. Simultaneously inner drive cable 28 rotates inner one-way clutch 26 in the opposite such that inner one-way clutch 26 engages resistance flywheel axle 38 and propels resistance axle 38 and resistance flywheel 31. While resistance flywheel axle 38 and resistance flywheel 31 are rotating, resistance magnet 32 is imparting a braking resistance against the rotation of resistance flywheel axle 38 and resistance flywheel 31 such that the movement of user engagement actuator pads 12 and user engagement actuator arm 11 are resisted.

The movement of user engagement actuator pads 12 and user engagement actuator arm 11 are only resisted by resistance system 30 when they are moving such that when user engagement actuator pads 12 and user engagement actuator arm 11 are not moving they are not acted upon by resistance system 30. However, outer one-way clutches 25 and inner one-way clutches 26 are disengaged and passive on resistance flywheel axle 38 when they are not moved by outer cable 27 and inner cable 28, therefore the inertia of resistance flywheel 31 will allow resistance flywheel axle 38 and resistance flywheel 31 to continue to rotate after the movement of drive system 20 has ceased until the braking force of resistance magnet 32 stops the rotation of resistance flywheel axle 38 and resistance flywheel 31. The first station of machine 10 can be operated simultaneously as the second station of machine 10, however the drive assembly 20 of each station operates independently such that the first station and the second station of machine 10 can jointly propel resistance flywheel axle 38 and resistance flywheel 31 without either station impeding the motion of the other.

The one-station embodiment of machine 10 as illustrated in FIG. 8 has one drive assembly 20 and supplemental support frame members 14 to support resistance system 30. The operation of the one-station embodiment of machine 10 is identical to the operation of the two-station embodiment of machine 10 as previously described herein.

Features and components of the preferred embodiment of the present invention include at least one user support, at least one user engagement actuator arm, at least one drive assembly and at least one resistance system. The user engagement actuator arm, the drive assembly and the resistance system are all operatively link to create a Dual Function Exercise Machines with Bi-Directional Resistance. The resistance for a first function of the machine can be can be greater, less, or equal to the resistance for the second function of the machine. The machine can be configured as two-stations or as one-station.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

What is claimed is:

1. A dual function exercise machine with bi-directional resistance, comprising:

a) a support frame;

b) a one-person user support mounted on the support frame;

c) at least one drive axle mounted on the support frame;

d) at least one first pulley having a first diameter respectively and rigidly mounted on each of the at least one drive axle and at least one second pulley having a second diameter respectively and rigidly mounted on each of the at least one drive axle, wherein the first diameter and the second diameter are different from each other;

e) at least one user engagement actuator respectively and operatively connected to each of the at least one drive axle;

f) a flywheel axle mounted on the support frame and a one-directional flywheel mounted on the flywheel axle;

g) a braking mechanism operatively engaged with the one-directional flywheel for providing resistance to the rotation of the one-directional flywheel;

h) at least one first one-way clutch operatively connected to the flywheel axle and at least one second one-way clutch operatively connected to the flywheel axle; and i) a first flexible component respectively and operatively connecting the at least one first pulley having the first diameter to the at least one first one-way clutch and a second flexible component respectively and operatively connecting the at least one second pulley having the second diameter to the at least one second one-way clutch;

wherein a first amount of force is required to move the at least one user engagement actuator in a push direction to rotate the at least one drive axle, the flywheel axle and the one-directional flywheel, and wherein a second amount of force that is different from the first amount of force is required to move the at least one user engagement actuator in a pull direction to rotate the at least one drive axle, the flywheel axle and the one-directional flywheel.

2. The exercise machine of claim 1, wherein the resistance generated by the breaking mechanism that is operatively engaged with the one-directional flywheel is adjustable prior to operation of the exercise machine or during operation of the exercise machine.

3. The exercise machine of claim 2, wherein the at least one drive axle and the at least one user engagement actuator are resisted by the one-directional flywheel only when the at least one drive axle and the at least one user engagement actuator are moving.

* * * * *